US006311586B1

(12) United States Patent
Hirse

(10) Patent No.: US 6,311,586 B1
(45) Date of Patent: Nov. 6, 2001

(54) SELF-CLAMPING WRENCH

(75) Inventor: Gernot Hirse, Frankfurt am Main (DE)

(73) Assignee: Hirse-Patent-Lizenz-GmbH, Frankfurt am Main (DE)

( * ) Notice: Subject to any disclaimer, the term of this patent is extended or adjusted under 35 U.S.C. 154(b) by 0 days.

(21) Appl. No.: 09/555,274

(22) PCT Filed: Nov. 20, 1998

(86) PCT No.: PCT/EP98/07483

§ 371 Date: Jun. 28, 2000

§ 102(e) Date: Jun. 28, 2000

(87) PCT Pub. No.: WO99/28090

PCT Pub. Date: Jun. 10, 1999

(30) Foreign Application Priority Data

Nov. 29, 1997 (DE) ..... 197 53 109

(51) Int. Cl.[7] ..... B25B 13/28
(52) U.S. Cl. ..... 81/99; 81/342
(58) Field of Search ..... 81/99, 111, 342, 81/381

(56) References Cited

U.S. PATENT DOCUMENTS

| | | | | |
|---|---|---|---|---|
| 120,144 | * | 10/1871 | Zeiler | 81/342 |
| 1,382,832 | * | 6/1921 | Hill | 81/321 |
| 1,582,071 | * | 4/1926 | Nordin | 81/381 |
| 1,627,035 | | 5/1927 | Jahn | 81/99 |
| 1,666,467 | * | 4/1928 | Peterson | 81/381 |
| 1,796,888 | * | 3/1931 | Davis | 81/381 |
| 2,057,899 | * | 10/1936 | Lucas | 81/99 |
| 3,418,873 | * | 12/1968 | Moriwaki | 81/99 |
| 4,594,922 | * | 6/1986 | Park et al. | 81/99 |
| 4,616,534 | | 10/1986 | Park et al. | 81/99 |
| 5,771,761 | * | 6/1998 | Binkowski | 81/99 |

FOREIGN PATENT DOCUMENTS

| | | |
|---|---|---|
| 1 299 570 | 7/1969 | (DE) . |
| 196 12 759 | 10/1997 | (DE) . |
| WO97/36717 | 10/1997 | (WO) . |

* cited by examiner

*Primary Examiner*—Joseph J. Hail, III
*Assistant Examiner*—David B Thomas
(74) *Attorney, Agent, or Firm*—Burns, Doane, Swecker & Mathis, L.L.P.

(57) ABSTRACT

A self-clamping wrench has one fixed clamping jaw, which is rigidly connected to a handle and one mobile clamping jaw, which is mounted thereon in such a way that it can turn. A hand lever is located on the handle on the same side as the mobile clamping jaw. A leaf spring, which is fixed on the hand lever, acts upon the mobile clamping jaw and when the hand lever is closed, forms a tension spring which pushes said clamping jaw into its closed position. When the hand lever is released, the leaf spring acts as a lever spring, which opens the hand lever and the mobile clamping jaw.

16 Claims, 2 Drawing Sheets

SELF-CLAMPING WRENCH

BACKGROUND OF THE INVENTION

The invention relates to a self-clamping wrench having a fixed clamping jaw, which is rigidly connected to a handle, and a mobile clamping jaw, which is pivotally mounted thereon whereby said mobile clamping jaw is pushed into its closed position by a tension spring. A spring-loaded hand lever is pivotally mounted to the handle, which engages the mobile clamping jaw.

Self-clamping wrenches are well known in a great number of various configurations. They have in common that the moment (torque) exerted on the workpiece during actuation of the wrench increases the tensioning force of the mobile clamping jaw. Such self-clamping wrenches are designed, for example, as spanner wrenches or pipe wrenches.

During manipulation of the wrench there is the need that the mouth of the wrench, which is formed between the fixed clamping jaw and the mobile clamping jaw, is kept open against the effects of the tension spring when the wrench is placed on the workpiece or when it is removed. During adjustment of the wrench between subsequent turning movements it is often times also an advantage if the mouth of the wrench can be opened against the effect of the tension spring, for example, to prevent damage to sensitive workpieces in case of toothed clamping jaws as, for instance, in plumbing or in the use on bolts made of synthetic material.

On a known self-clamping wrench of the type mentioned in the beginning and as disclosed in U.S. Pat. No. 4,616,534, there is for this purpose a hand lever mounted on the handle at the opposite side of the mobile clamping jaw, which may be pushed toward the handle against the force of the lever spring. An arm of the lever engages thereby a protrusion on the mobile clamping jaw facing the handle to swing said clamping jaw into an open position and to keep it open. The self-clamping function of the mobile clamping jaw is activated by the effect of the tension spring only when the hand lever is released.

Manipulation of this wrench is relatively complicated since the hand (operating) lever must be moved and held in place against the force of its lever spring to open or keep open the mouth of the wrench. Should the hand lever be released unintentionally during the use of the wrench, for example during re-gripping between two subsequent turning movements, then the mount of the wrench closes shut. This is disturbing during the operation of the wrench and it may cause damage to sensitive workpieces, particularly when toothed clamping jaws are used.

On another known wrench (disclosed in DE-A-1 299 570), which is not self-clamping, a hand lever mounted on the handle is used to close the mouth of the wrench in a movement similar to that of pliers until it grasps the workpiece and then locks the slidable—but not pivotable—mobile clamping jaw with a cam that is joined to the hand lever. The transmission of motion between the hand lever and the mobile clamping jaw is caused by a leaf spring that is attached to the hand lever, which engages a recess on the mobile clamping jaw that faces the handle.

On another known closed-end jaw wrench, disclosed in U.S. Pat. No. 4,594,922, the handle lever mounted on the handle body is used to move a pivotable closed-end jaw into a clamping position. The hand lever has to be held in place by a locking device. A tension spring does not exist to push the closed-end jaw into the clamping position by the force of a spring.

The object of the invention is to design a self-clamping wrench of the type mentioned in the beginning whereby it can be manipulated in a simple manner and whereby the self-clamping effect occurs only when the wrench is placed on the workpiece for the performance of a moment (torque); otherwise, the mouth of the wrench should open automatically and should remain in an open position.

SUMMARY OF THE INVENTION

This object is achieved according to the invention in that the hand lever is disposed on the same side of the wrench as the mobile clamping jaw and whereby said hand lever is moved by the force of the spring in a position that keeps the mobile clamping jaw in an open position.

This arrangement of the hand lever makes possible that said hand lever is actuated in an ergonomically favorable manner if at the same time a torque is to be applied onto the workpiece by the wrench. The hand, which grasps the handle to apply torque to the workpiece, moves thereby the hand lever automatically toward the handle without additional actuating measures, and effects thereby the force of the tension spring, which in turn pushes the mobile clamping jaw into it closed position. Should the hand be moved away from the handle, the hand lever swings away from the handle as well and opens the mouth of the wrench. The hand lever is kept in a position by the force of the spring in which is also keeps the mouth of the wrench open against the force of the tension spring. The mobile clamping jaw will resume its self-clamping closed position under the force of the tension spring only when the hand lever is moved again toward the handle.

According to one embodiment of the invention it is proposed that the hand lever is designed as a double-armed lever whereby its one arm engages a recess on the mobile clamping jaw facing the handle and whereby the hand lever is moved into a position holding the mobile clamping jaw open by a lever spring. The lever spring is designed thereby in such a manner that it overcomes the force of the tension spring and the tension spring becomes subsequently effective and moves the mobile clamping jaw in the direction of its self-clamping closed position only when the effect of the lever spring is stopped by actuating the hand lever.

The tension spring may be attached to the handle or the hand lever. It may engage the recess or a slot on the mobile clamping jaw that faces the handle.

Additional advantageous configurations of the embodiment are an object of further minor claims.

BRIEF DESCRIPTION OF THE DRAWINGS

Exemplary embodiments are described in more detail below with reference to the drawings in respective longitudinal cross-sectional views.

DETAILED DESCRIPTION OF PREFERRED EMBODIMENTS OF THE INVENTION

Figure 1:
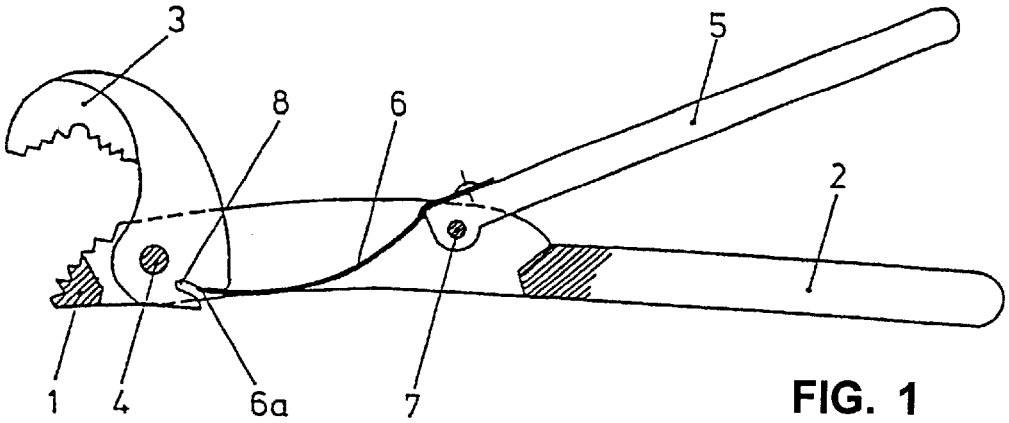
FIG. 1 shows a wrench in an open position with a leaf spring that engages a slot in the mobile clamping jaw whereby said leaf spring is attached to the hand lever.
Figure 2:
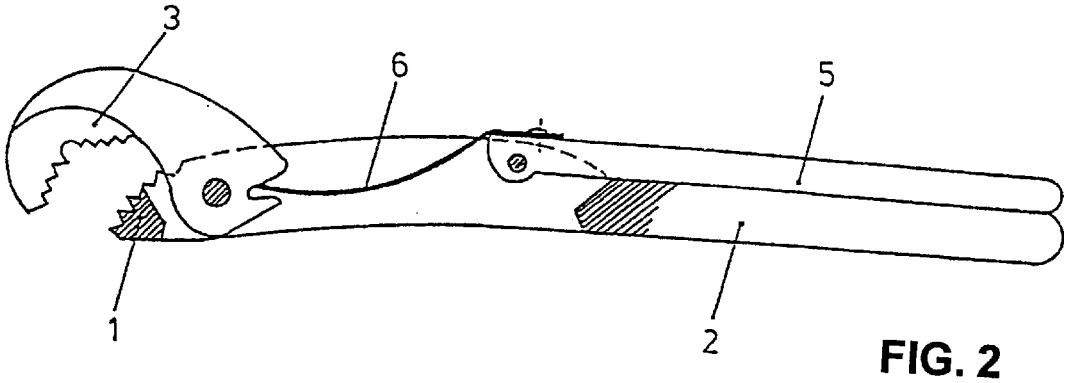
FIG. 2 shows a wrench according to FIG. 1 in a closed clamping position.

The self-clamping wrench in FIG. 1 and FIG. 2, illustrated in a respective open or closed position, is provided with a fixed clamping jaw 1, which is rigidly connected to a handle 2. A mobile clamping jaw 3 is mounted at a joint 4 between the fixed clamping jaw 1 and the handle 2. The toothed clamping surface of the fixed clamping jaw 1 and the mobile clamping jaw 3 shown in the embodiment example are arranged relative to the pivoting axis formed by the joint 4 in such a manner that the wrench exerts a self-clamping force on the workpiece during actuation.

A hand lever 5 is mounted between the joint 4 and the handle 2 whereby said hand lever is disposed on the same side of the handle 2 as the mobile clamping jaw 3. A leaf spring 6 is attached with one of its ends to the hand lever 5 near its lever joint 7, it is preferably riveted to it and engages with its free end 6*a* the slot 8 of the mobile clamping jaw 3 that is facing the handle. Depending on the respective position of the hand lever 5, the leaf spring 6 acts either as a tension spring that moves the mobile clamping jaw 3 in the direction of its closed position, or it is a lever spring that keeps open the hand lever 5 and the mobile clamping jaw 3.

Should the hand lever 5 be released, then the pre-tensioned force of the leaf spring 6 causes the hand lever 5 to move into the open position as shown in FIG. 1. However, the leaf spring 6 also moves at the same time the mobile clamping jaw 3 into its open position. The wrench can be handled in this position whereby the mouth of the wrench does not close by itself. In particular, the wrench with its open mouth may be placed or removed from the workpiece or reset on the workpiece between two subsequent turning movements.

Should the hand lever 5 be placed against the handle 2, as shown in FIG. 2 (this position is considered "closed" in this connection), then the leaf spring 6 swings the mobile clamping jaw in the direction of its closed position and acts simultaneously as a tension spring to hold the mobile clamping jaw against the workpiece in its closed position by the force of the spring. The closing of the hand lever 5 is performed in an ergonomically simple manner in that the handle 2 and the hand lever 5 are grasped by hand to effect a moment (torque) on the workpiece (clockwise in FIG. 2). When the force on the handle 2 and the hand lever 5 is released at the end of a turning movement, then the hand lever 5 as well as the mouth of the wrench move into an open position; all parts subsequently return again to the open position as shown in FIG. 1. The tension spring for the mobile clamping jaw 3 and the spring for the hand lever 5 are hereby in form of the leaf spring 6, which is attached to the hand lever 5 and which engages the mobile clamping jaw 3 in a longitudinal direction.

Figure 3:
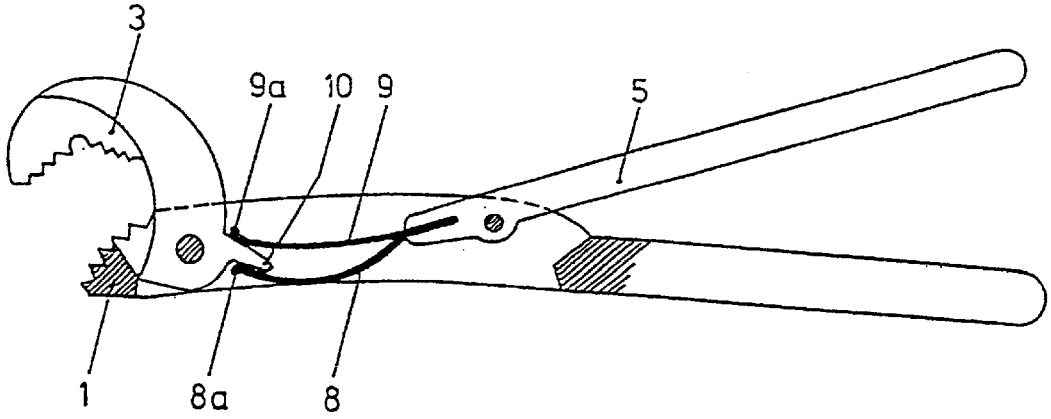
FIG. 3 shows a wrench with two leaf springs, which are attached to the hand lever and which engage the mobile clamping jaw.

The embodiment in FIG. 3 differs from the described embodiment example in that two leaf springs 8 and 9 are attached to the hand lever 5, which free ends 8*a* or 9*a* engage both sides of a toe 10 on the mobile clamping 3 facing the handle. The two leaf springs 8 and 9 act thereby as a tension spring for the mobile clamping jaw 3 and also as a spring for the hand lever 5.

Figure 4:
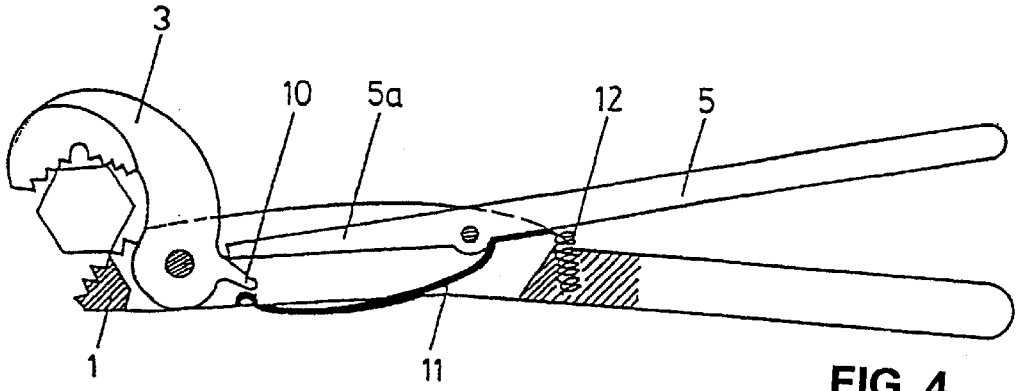
FIG. 4 shows an arm of the hand lever that engages the mobile clamping jaw and it also shows a leaf spring.
Figure 5:
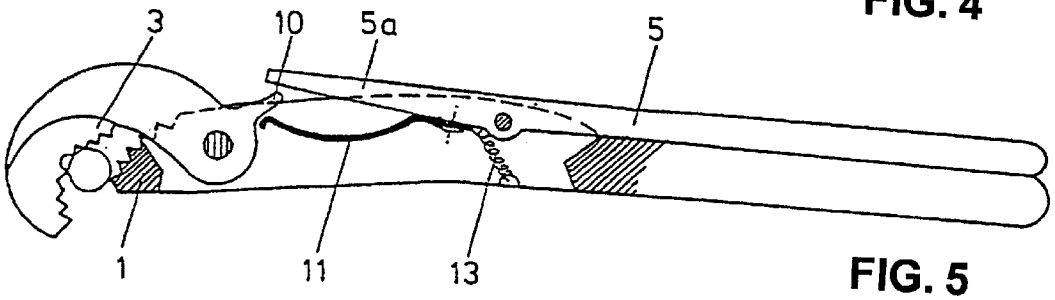
FIG. 5 shows a modified version of FIG. 4.
Figure 6:
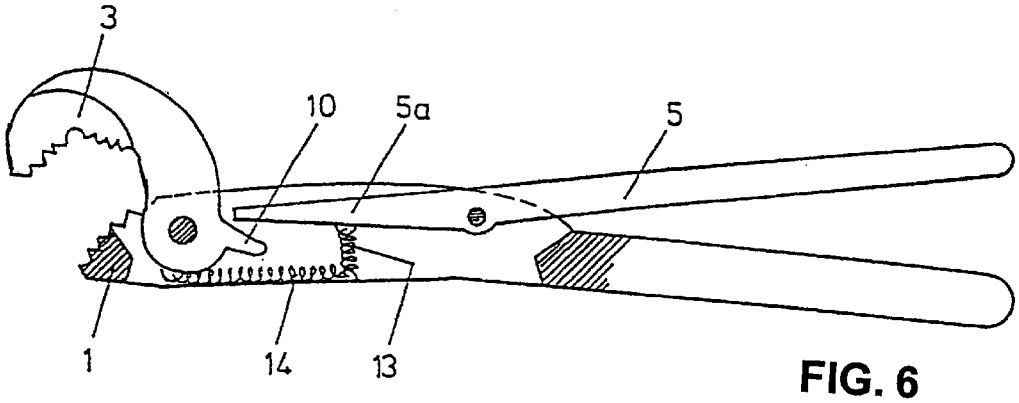
FIG. 6 shows an additional modified version.

The embodiment examples in FIGS. 4, 5 and 6, respectively have in common that the hand lever 5 is designed as a double-armed lever, which engages with one lever arm 5*a* the toe 10 of the mobile clamping jaw 3 facing the handle to move said clamping jaw into its open position while the lever is also in an open position.

In the example in FIG. 4 and FIG. 5, a leaf spring 1, which is attached to the hand lever 5 and which engages the toe 10 opposite the lever arm 5*a*, acts as a tension spring that pushes the mobile clamping jaw 3 in the direction of its closed position. A lever spring, which is designed in FIG. 4 as a pressure spring 12 and in FIG. 5 as a pull-type spring 13, moves the hand lever 5 into its open position whereby the force of said lever spring is so great that it overcomes the force of the tension spring 1. Thus, the open position of the hand lever 5 and the mobile jaw 3 are the inoperative position of the wrench.

The embodiment example in FIG. 6 differs thereby only by the fact that a pull-type spring 14, which is mounted on the handle part and which is connected to the mobile clamping jaw 3, acts as the tension spring. A pull-type spring 14, which works similar between the handle part and the lever arm 5*a*, as shown in example in FIG. 5, acts as the lever spring. The force of the lever spring 13 is here also so great that it overcomes the force of the tension spring 14 in the released condition of the wrench, so that the mobile clamping jaw 3 is held in its open position until the hand lever 5 is pushed into a closed position and the force of the lever spring 13 is thereby cancelled.

Figure 7:
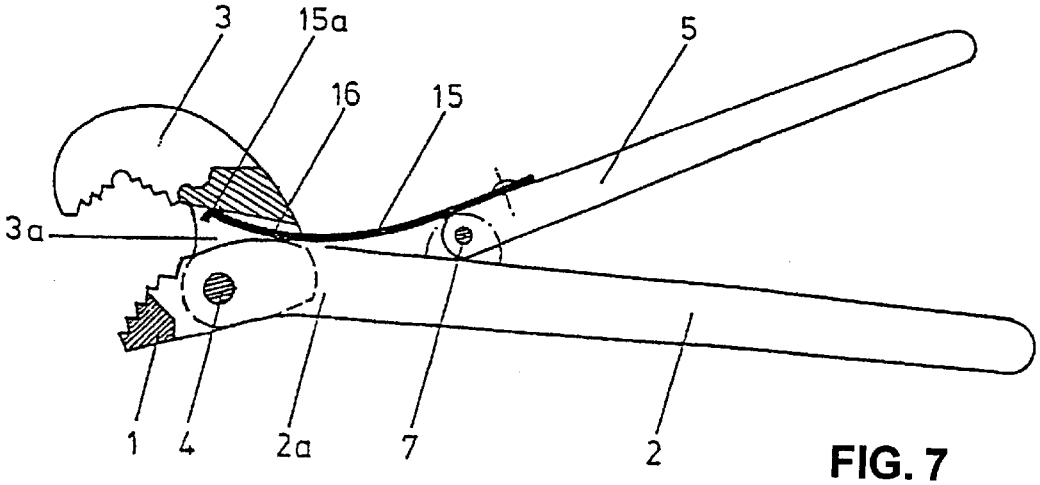
FIG. 7 shows a wrench having a single leaf spring, which is attached to the hand lever and which engages a contact surface on the mobile clamping jaw.

In the embodiment example shown in FIG. 7, the mobile clamping jaw 3 is provided with two jaw extensions 3*a*, which both engage a middle segment 2*a* of the handle piece. A leaf spring 15 is attached to the hand lever 5 at a distance from the pivoting axis of the hand lever 5 (which axis is formed by the joint 7) in such a manner that the free end 15*a* of said leaf spring is moved during closing of the hand lever 5 in a longitudinal direction relative to the wrench whereby it effects an opening moment on the mobile clamping jaw 3 when the hand lever 5 is open, and a closing moment when said hand lever is closed.

In the illustrated embodiment example, the leaf spring 15 is attached to the hand lever 5 on the side facing away from the handle 2 and engages with its free end 15*a* a contact surface 16 of the mobile clamping jaw 3 between the two extensions 3*a*. The leaf spring 15 is preferably braced with its middle segment against the top side of the segment 2*a* of the handle piece. The contact surface 16 is offset opposite the pivoting axis, which is formed by the joint 4, in the direction toward the mobile clamping jaw 3. The free end 15*a* of the leaf spring 15 engages in the area of the pivoting axis (joint 4) the contact surface 16 in such a manner that the point of engagement, while the hand lever 5 is open, is located in the direction toward the mouth of the wrench and in front of the pivoting axis of the joint 4 and thereby effects an opening moment onto the mobile clamping jaw 3. Should the hand lever 5 be closed, then the point of engagement of the free end 11*a* moves toward the handle 2 and behind the pivoting axis of joint 4. This has the effect that a moment (torque) is created, which is directed counter-clockwise relative to FIG. 7 and which pushes the mobile clamping jaw 3 into its locked or closed position.

The leaf spring 15 acts thereby also as the tension spring for the mobile clamping jaw 3 and as the lever spring for the hand lever 5. Depending on the position of the hand lever 5, the force of the tension spring that closes the clamping jaw 3 is preponderant and so is the force of the lever spring that opens the hand lever 5 and thereby also the clamping jaw 3.

What is claimed is:

1. A self-clamping wrench comprising:

a fixed portion including a handle and a fixed clamping jaw attached thereto;

a mobile clamping jaw disposed on one side of the fixed portion and pivotably mounted to the fixed portion for swinging movement toward and away from the fixed clamping jaw between closed and open positions, respectively; and an actuating portion including:

a hand lever disposed on the same side of the fixed portion as the mobile clamping jaw and pivotably mounted to the fixed portion for swinging movement between an open position for opening the mobile clamping jaw, and a closed position for closing the mobile clamping jaw, and a spring arrangement for applying a biasing force for biasing the mobile clamping jaw and the hand lever toward their respective open positions, wherein said spring transmits a jaw-closing force from the hand lever to the mobile jaw in response to the hand lever being swung toward its closed position against the biasing force.

2. The self-clamping wrench according to claim 1 wherein the spring arrangement comprises a single spring for both applying the biasing force and transmitting the jaw-closing force.

3. The self-clamping wrench according to claim 2 wherein the single spring comprises a leaf spring.

4. The self-clamping wrench according to claim 3 wherein a first end of the leaf spring is fixed to the hand lever and a second end of the leaf spring abuts the mobile clamping jaw.

5. The self-clamping wrench according to claim 4 wherein the second end of the leaf spring is disposed in a slot formed in the mobile clamping jaw.

6. The self-clamping wrench according to claim 4 wherein the second end of the leaf spring slides along a contact surface of the mobile clamping jaw in response to swinging of the hand lever, whereby the second end of the leaf spring engages the contact surface at a first location thereon for biasing the mobile clamping jaw toward its open position when the handle lever is in its open position, and engages the contact surface at a second location thereon for biasing the mobile clamping jaw toward its closed position when the hand lever is in its closed position.

7. The self-clamping wrench according to claim 6 wherein the first end of the leaf spring engages a side of the hand lever facing away from the handle; a portion of the leaf spring disposed between the first and second ends of the leaf spring engaging a surface of the fixed portion which faces toward the contact surface of the mobile clamping jaw.

8. The self-clamping wrench according to claim 1 wherein the spring arrangement comprises a pair of leaf springs, each leaf spring including first and second ends, the first ends being fixed to the hand lever, and the second ends engaging the mobile clamping jaw.

9. The self-clamping wrench according to claim 8 wherein the mobile clamping jaw includes a toe extending generally toward the hand lever, the first ends of the leaf springs engaging opposite respective sides of the toe.

10. The self-clamping wrench according to claim 1 wherein the mobile clamping jaw includes a toe extending generally toward the hand lever, the handle lever being pivotably connected to the fixed portion intermediate first and second ends of the hand lever, the second end of the hand lever arranged to contact the toe to apply a jaw-opening force to the toe in response to the hand lever being biased open by the spring arrangement.

11. The self-clamping wrench according to claim 10 wherein the spring arrangement comprises a first spring for applying the biasing force and a second spring for transmitting the jaw-closing force.

12. The self-clamping wrench according to claim 11 wherein the second spring comprises a leaf spring.

13. The self-clamping wrench according to claim 12 wherein one end of the leaf spring is fixed to the hand lever, and a second end of the leaf spring engages a side of the toe opposite to a side thereof engaged by the second end of the hand lever.

14. The self-clamping wrench according to claim 1 wherein the spring arrangement comprises a first spring for applying the biasing force and a second spring for transmitting the jaw-closing force.

15. The self-clamping wrench according to claim 14 wherein the second spring comprises a leaf spring.

16. A self-clamping wrench comprising:

a fixed portion including a handle and a fixed clamping jaw attached thereto;

a mobile clamping jaw disposed on one side of the fixed portion and pivotably mounted to the fixed portion for swinging movement toward and away from the fixed clamping jaw between closed and open positions, respectively; and an actuating portion including:

a hand lever disposed on the same side of the fixed portion as the mobile clamping jaw and pivotably mounted to the fixed portion for swinging movement between a first position for opening the mobile clamping jaw, and a second position for enabling the mobile clamping jaw to be closed, a first spring acting between the fixed portion and the clamping jaw for continuously biasing the clamping jaw toward its closed position, and a second spring acting between the fixed portion and the hand lever for continuously biasing the hand lever toward its first position for opening the clamping jaw, the second spring being stronger than the first spring so that the clamping jaw is normally biased into its open position, the clamping jaw being movable to its closed position by the first spring in response to the handle being manually swung to its second position.

* * * * *